US006836255B1

(12) United States Patent
Davis

(10) Patent No.: US 6,836,255 B1
(45) Date of Patent: Dec. 28, 2004

(54) LIMITED FIELD OF VIEW ANTENNA FOR SPACE BORNE APPLICATIONS

(75) Inventor: Daniel Davis, Baltimore, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 1054 days.

(21) Appl. No.: 09/596,492

(22) Filed: Jun. 19, 2000

Related U.S. Application Data

(60) Provisional application No. 60/177,282, filed on Jan. 21, 2000.

(51) Int. Cl.[7] ..... H01Q 13/00

(52) U.S. Cl. ..... 343/781 P; 343/840; 343/915

(58) Field of Search ..... 343/781 P, 781 R, 343/775, 776, 840, 912, 915, DIG. 2, 893

(56) References Cited

U.S. PATENT DOCUMENTS

| | | | | |
|---|---|---|---|---|
| 4,259,674 A | | 3/1981 | Dragone et al. | 343/909 |
| 4,896,165 A | | 1/1990 | Koizumi | 343/881 |
| 6,268,835 B1 | * | 7/2001 | Toland et al. | 343/781 P |

* cited by examiner

*Primary Examiner*—Hoang V. Nguyen
(74) *Attorney, Agent, or Firm*—Birch, Stewart, Kolasch & Birch, LLP

(57) ABSTRACT

A hybrid parabolic reflector phased array antenna system which is stowable in a space vehicle and is deployable in space. The antenna includes a large torus which acts as a support structure for a plurality of small reflector cells called super elements, each including its own reflector and an array of feed elements. The torus supports a stretched reflector mesh and matching back-up catanary wires that provide a mechanism for pulling the reflector surface of the cells down to an exact paraboloid. A set of rigid corner posts for stretching the mesh fabric for forming multiple reflectors is also provided. The torus is also used to support individual super element feed arrays for each reflector. The super elements incrementally scan the beam by group selection of feed elements in each feed array with time delay phase control being used to steer the array factor so as to achieve fine steering. Each of the super elements scans incrementally with a selected group of feed elements varying between three and twelve, which are varied in position relative to the focal axis of the feed array. The groups of feed elements of the feed arrays are also controlled so as to mitigate any undesired grating lobe problem.

44 Claims, 17 Drawing Sheets

LIMITED FIELD OF VIEW ANTENNA FOR SPACE BORNE APPLICATIONS

This application claims priority on provisional Application No. 60/177,282 filed on Jan. 21, 2000, the entire contents of which are hereby incorporated by reference.

BACKGROUND OF THE INVENTION

1. Field of the Invention

This invention relates generally to antennas used for space applications and more particularly to a hybrid parabolic reflector phased array antenna which is stowed in a collapsed state for launch and thereafter deployed to form a relatively large reflector type antenna when in orbit.

2. Description of Related Art

Extremely large scanning antennas for space applications and having limited scan requirements are well known. As the antenna is moved away from the earth, the scan angles are reduced, while the size of the antenna increases. The problem of deploying and steering very large antennas is formidable. Phased arrays generally have too many elements to be cost effective while reflector antennas have configuration problems in amount of blockage and performance degradation at the edges of scan.

Currently, large scanning antennas use parabolic reflectors with clusters of elements at and near the focal point to scan the beam. In order to steer the antenna, a large group of elements are used to transmit and receive. On transmit, phase-only control is preferred, while on receive both phase and amplitude controls are used. Moreover, on transmit, amplitude is uniform while in receive it is normally tapered. In order to distribute the power among many elements to reduce the heat concentration, the feed array is typically displaced forward of the focal point; however, this increases the size of the feed rapidly, with commensurate increase in blockage loss.

Apertures comprised of a plurality of reflector super elements, all having feed array generating respective antenna patterns, steer a composite beam pattern near the desired direction. In such apparatus, phase or time delay between elements is then used to fine steer the antenna. With large spacing between elements, however, grating lobes are formed, which is the classic problem of using a large element in a phased array. At beam positions between element pointing positions, there can be major grating lobes that sap the power from the main beam and that, in turn, raise serious clutter problems.

SUMMARY

The present invention is directed to a hybrid parabolic reflector phased array antenna system which is stowable in a rocket and is deployable in space. The antenna includes a large torus which acts as a support structure for a plurality of small reflector cells called super elements, each including its own reflector and an array of feed elements. The torus supports a stretched reflector mesh and matching back-up catanary wires that provide a mechanism for pulling the reflector surface of the cells down to an exact paraboloid. A set of rigid corner posts for stretching the mesh fabric for forming multiple reflectors is also provided. The torus is also used to support individual super element feed arrays for each reflector. The super elements incrementally scan the beam by group selection of feed elements in each feed array with time delay phase control being used to steer the array factor so as to achieve fine steering. Each of the super elements scans incrementally with a selected group of feed elements varying between three and twelve, which are varied in position relative to the focal axis of the feed array. At intermediate positions, where grating lobes appear, the groups of feed elements are reduced in number and selected so as to steer precisely to this position, thus relieving the grating lobe problem. Other methods of mitigating the grating lobe problem include randomly selecting groups of elements about the optimum position, gradually shifting the selected group of elements from one position to another, randomly positioning the feed arrays about their respective focal points, and overlapping feed distributions to gradually shift the feed center and thus precisely adjusting the feed element pattern to agree with the array factor peak position.

DESCRIPTION OF THE DRAWINGS

The present invention will become more fully understood from the detailed description provided hereinbelow and the accompanying drawings which are provided by way of illustration only, and thus are not limitative of the present invention, and wherein.

DETAILED DESCRIPTION OF THE INVENTION

Figure 1:
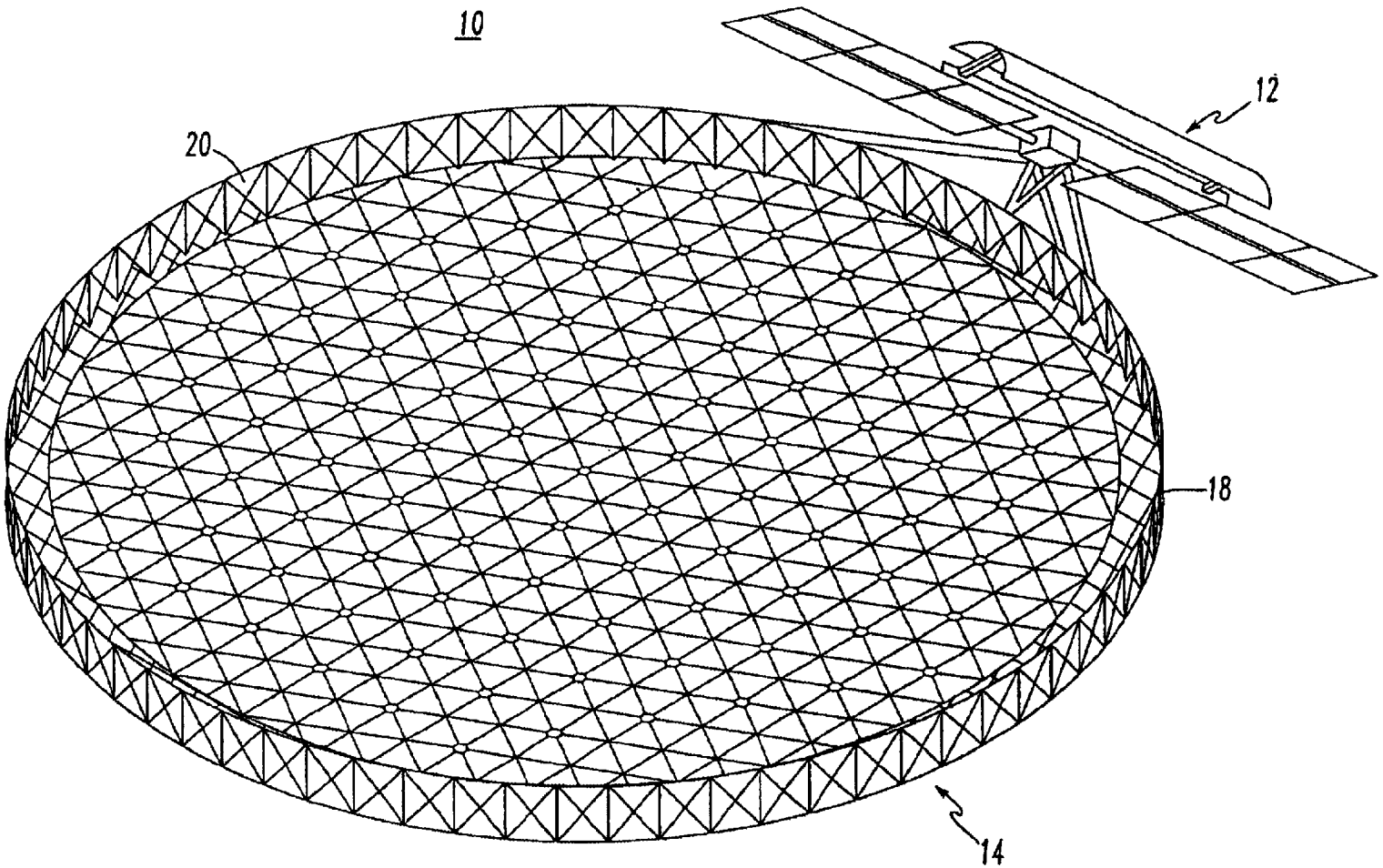
FIG. 1 is a perspective view generally illustrative of a space borne antenna system including an embodiment of the subject invention.
Figure 2:
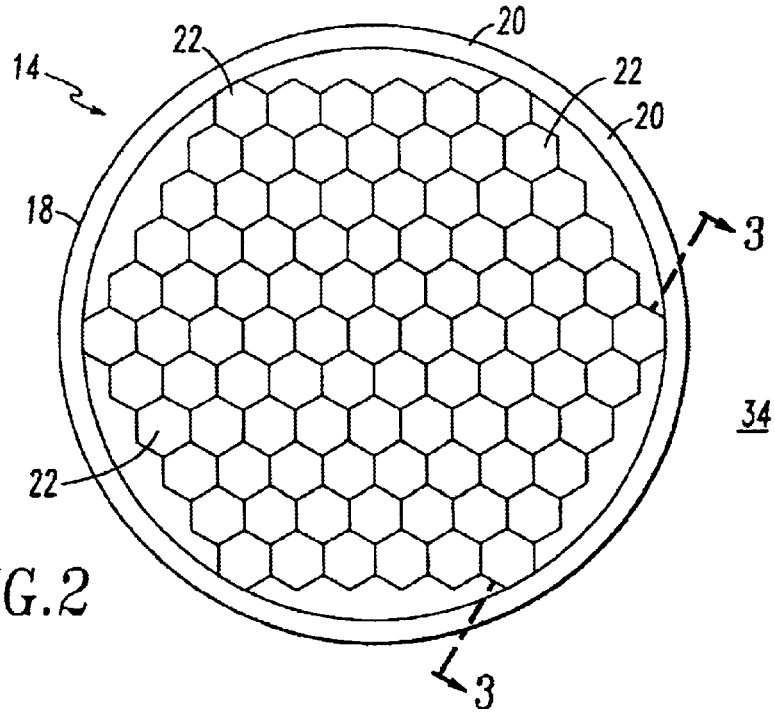
FIG. 2 is a front planar view of the L-band subsystem shown in FIG. 1 which forms the subject invention.
Figure 3:
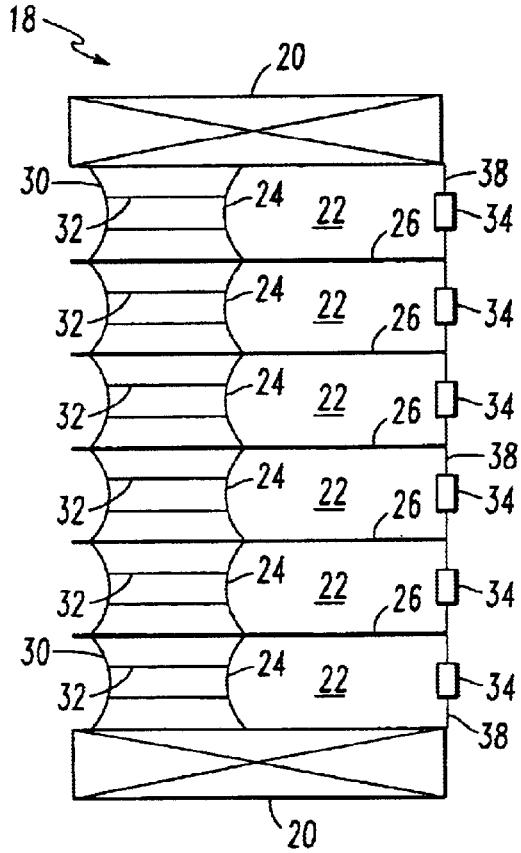
FIG. 3 is illustrative of a cross-section of the antenna structure shown in FIG. 2 taken along the lines 3—3 thereof.
Figure 4A:
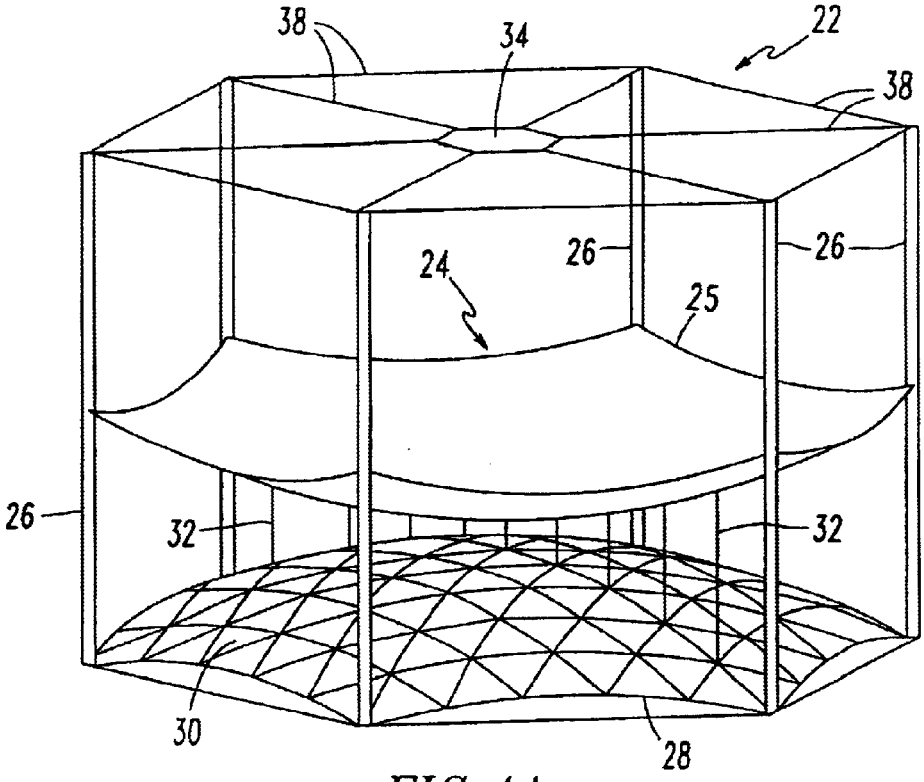
FIG. 4A is a perspective view illustrative of the details of a single super element cell of the antenna structure shown in FIG. 3.

Referring now to the figures wherein like reference numerals refer to like parts throughout, FIG. 1 depicts a space borne antenna system 10 including an X-band sub-system 12 and an L-band sub-system 14. The present invention is directed to the L-band sub-system 14, the details of which are shown in FIGS. 2–4. The L-band sub-system 14 comprises a relatively large inflatable antenna assembly 18 which includes a torus support structure 20 (FIG. 2) which is, for-example, 50 meters in diameter and supports 91 contiguous reflector super elements 22. A cross-section of the antenna assembly 18 taken along the lines 3—3 of FIG. 2 is shown in FIG. 3. Each reflector cell 22 as shown in FIGS. 3 and 4A includes a mesh-type parabolic reflector 24 having a hexagonal outline or perimeter 25. The mesh reflector 24 is supported at its six corners by rigid post members 26 which when the antenna is deployed, stiffen the mesh reflector 24 as well back-up suspension cables 28 which form a web 30 and a set of drop lines 32 which act to pull the mesh-type reflector 24 into a parabolic shape.

Figure 5:
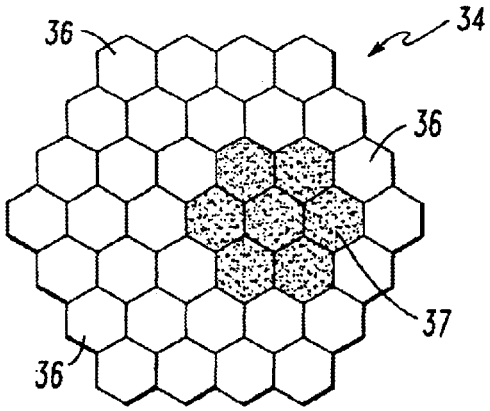
FIG. 5 is a front planar view of a multi-element feed array in accordance with the subject invention, with a group of seven feed elements being activated.

Each reflector super element 22 also includes a multi-element feed array 34 consisting of, for example, a cluster of thirty seven contiguous feed elements 36 as shown in FIG. 5. The feed array 34, moreover, is suspended above the concave surface of the reflector 24 by means of a set of suspension cables 38 which extend between the rigid support posts 26 and the feed array 34. Although not immediately evident, cable members 38 are also included along the edges of the mesh reflector 24 between the posts 26 so that the mesh does not stretch along the edges when the reflector surface is pulled down by the drop lines 32 and a suspension cable 28.

Figure 4B:
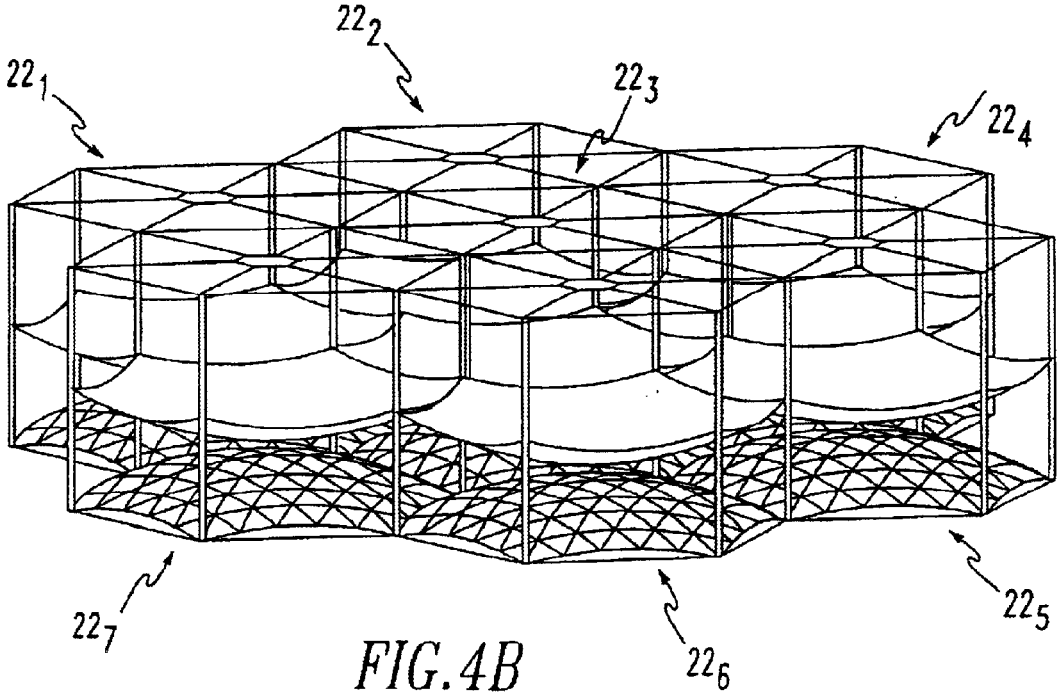
FIG. 4 is a perspective view of seven contiguous super element cells for the antenna shown in FIGS. 2 and 3.

While FIG. 4A discloses the mechanical details of a single reflector super element cell 22, FIG. 4B is illustrative of a group of seven contiguous reflector cells $\mathbf{22}_1$, $\mathbf{22}_2$, . . . $\mathbf{22}_7$. It should be noted that in such an arrangement, one support post 26 in many cases occurs at the intersection of three reflectors 24 of contiguous super element reflector cells such that, for example, at the intersection of three surfaces, a "Y" is formed. The rigid post elements 26 also act to maintain alignment of the various reflector cells 22.

Figure 6:
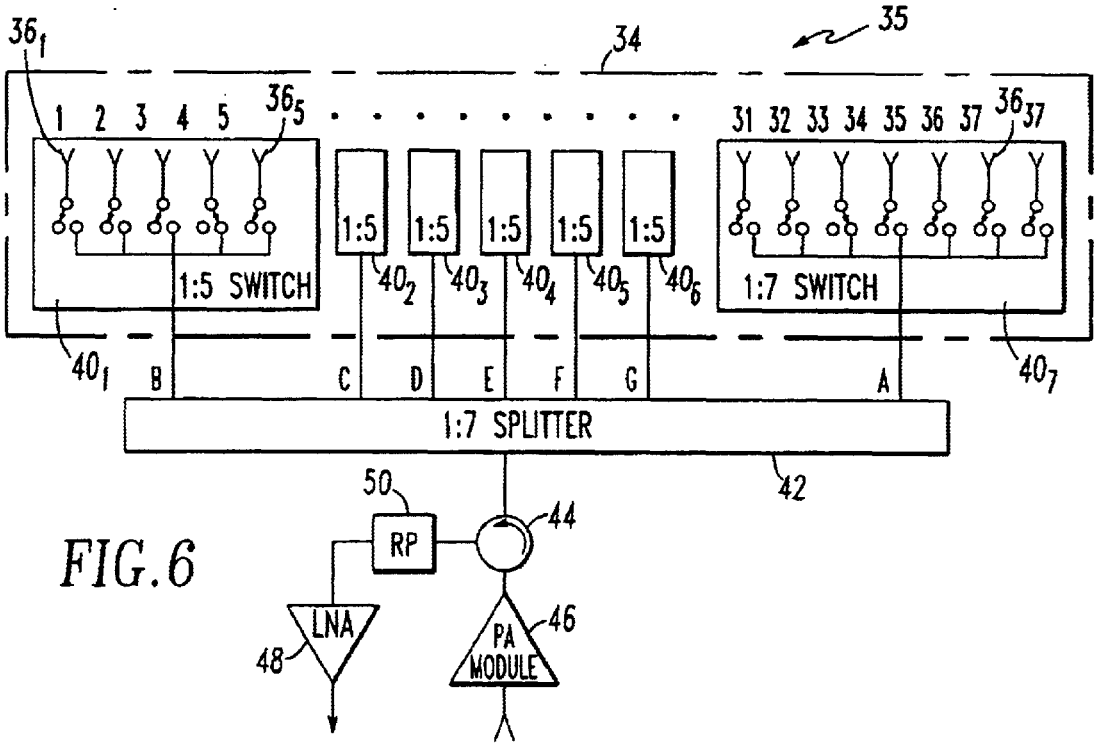
FIG. 6 is an electrical block diagram of control circuitry for selectively activating a selected group of feed elements shown in FIG. 5.
Figure 7:
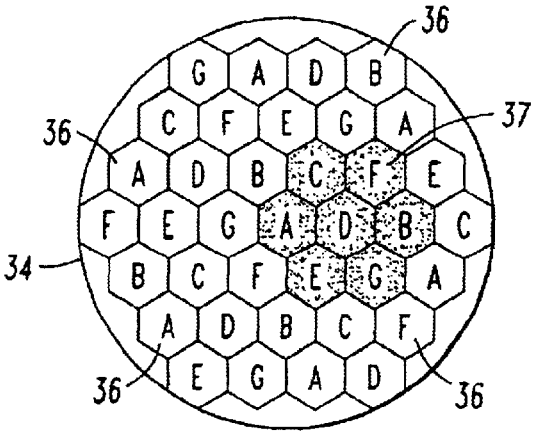
FIG. 7 is a diagram illustrative of the physical arrangement of the feed elements which are activated in accordance with the control circuitry shown in FIG. 6.

Referring now to FIGS. 5, 6 and 7, shown thereat are the details of the feed array 34 for each reflector super element 22. As noted above, each feed array 34 includes thirty seven discrete feed elements 36 which are activated to transmit (Tx) and receive (Rx) power via a switch matrix 35 shown in FIG. 6. The switch matrix 35 includes seven sets of switches $\mathbf{40}_1$, $\mathbf{40}_2$, . . . $\mathbf{40}_7$ where the first six sets of switches $\mathbf{40}_1$, . . . $\mathbf{40}_6$ includes a set of five single-pole, double-throw switches, while the seventh set of switches $\mathbf{40}_7$ include seven single-pole, double-throw switches of which only six are used. Thus, each feed element is connected to a respective single-pole, double-throw switch. The seven sets of switches are connected to a 1:7 signal splitter 42, which is coupled to a circulator 44 which receives transmit signals from a power amplifier module 46 and feeds received signals to a low noise amplifier via a receiver protector device 50.

Figure 8A:
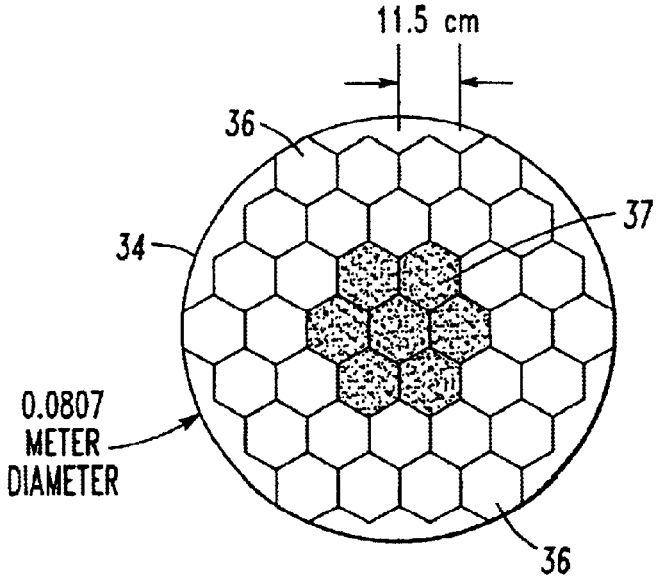
FIGS. 8A, 8B and 8C are illustrative of the manner in which seven elements in a feed array can be selectively activated so as to move the group of activated elements over the face of the feed array.
Figure 8B:
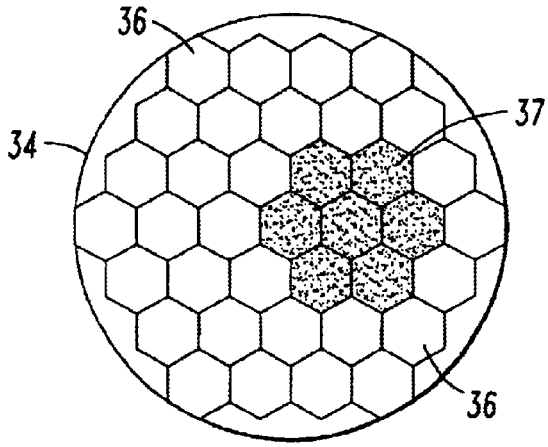
Figure 8C:
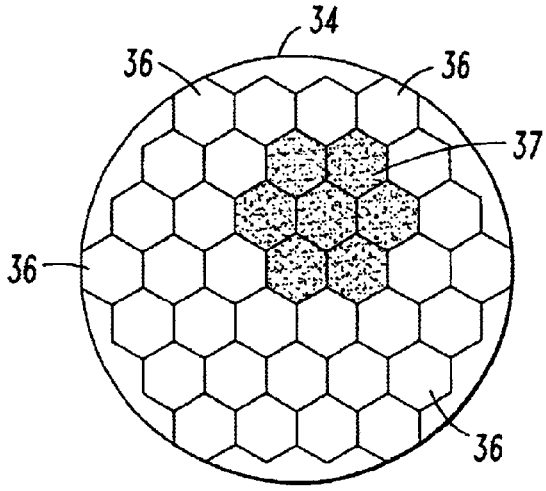

It can be seen with respect to FIG. 7 that the signal splitter 42 is operable to feed seven elements at a time in a pattern A, B, C, . . . G shown in FIG. 7 to form a cluster or group 37 of feed elements 36 at the position shown in FIG. 5. This position comprises one of a plurality of positions on the face of the feed array 34, as shown, for example in FIGS. 8A, 8B and 8C. As shown in FIG. 8A, a group of seven feed elements are selected at the center of the array, whereas in FIG. 8B, a group of seven elements are selected to the right of the array which corresponds to that shown in FIGS. 5 and 7, while the group shown in FIG. 8C comprises a group of seven elements 36 located above and to the right of the array. A group 37 of feed elements 36 is not limited to a fixed number of elements, such as seven elements, but can be made to be variable with as many as, for example, twelve feed elements in a group, however, the design of FIG. 6 would change.

There are two mechanisms for steering the array. One comprises feed group selection. The other mechanism is time delay steering the array factor. Accordingly, where a plurality of super element reflector cells form a phased array antenna system such as shown in FIGS. 1–3, reflector feed group selection includes selecting a specific feed group for a beam covered region wherein similar groups in each feed are selected, and wherein all of the super element individual reflectors produce a broad element pattern in the same direction. Time delay steering of the array factor results in providing fine steering control and is achieved by time delay units, not shown, which adjust the relative delay between super element reflector cells. Examples of array steering by reflector feed group selection and time delay steering the array factor is shown in FIGS. 9–12.

Figure 9A:
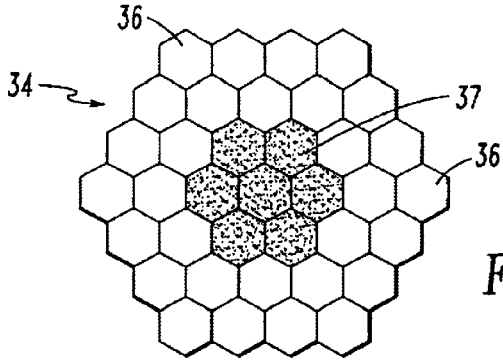
FIGS. 9A and 9B are illustrative of the array steering mechanism where feed group selection steers a super element beam at 0° with time delay units also steering the array factor to 0°.
Figure 9B:
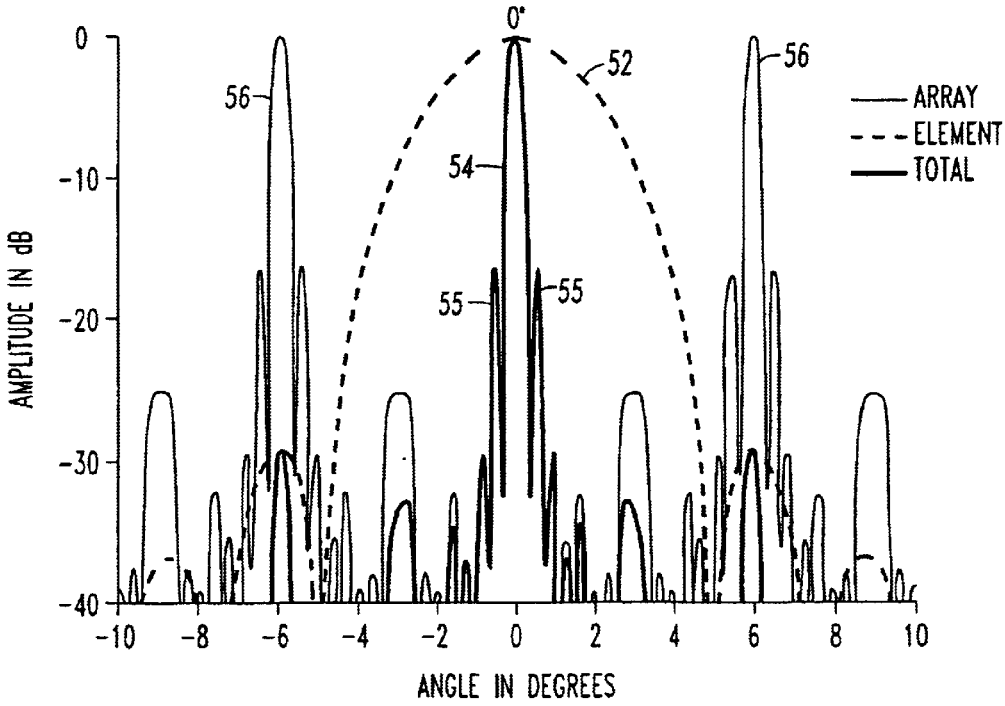

Referring now to FIGS. 9A and 9B they are illustrative of the array steering mechanism where feed array 34 steers a super element beam generated by feed array 37 in FIG. 9A to 0° with time delay units also steering the array factor to 0°. As shown in FIG. 9A, the feed element of group 37 is centered in the feed element array 34. With no array factor steering being applied, an antenna pattern as shown in FIG. 9B results. In FIG. 9B, reference numeral 52 depicts the super element beam pattern generated by the selected feed element group 37. The composite antenna pattern of the entire phased array antenna system as shown in FIGS. 2 and 3 includes a main lobe 54, and pairs of side lobes 55. Array factor steering is indicated by the position of a pair of grating lobes 56 on either side of the main lobe 54.

Figure 10A:
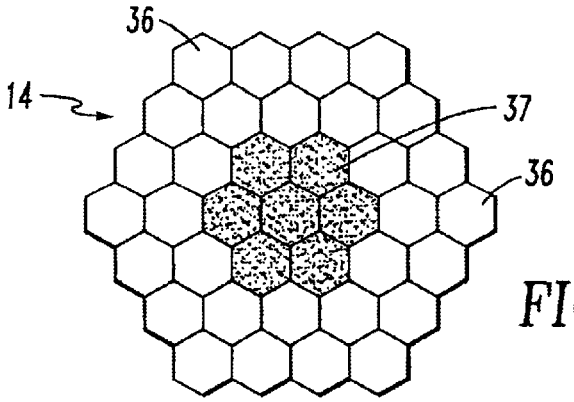
FIGS. 10A and 10B are illustrative of the array steering mechanism where feed group selection steers a super element beam to 0° while time delay units steer the array factor to 1.1°.
Figure 10B:
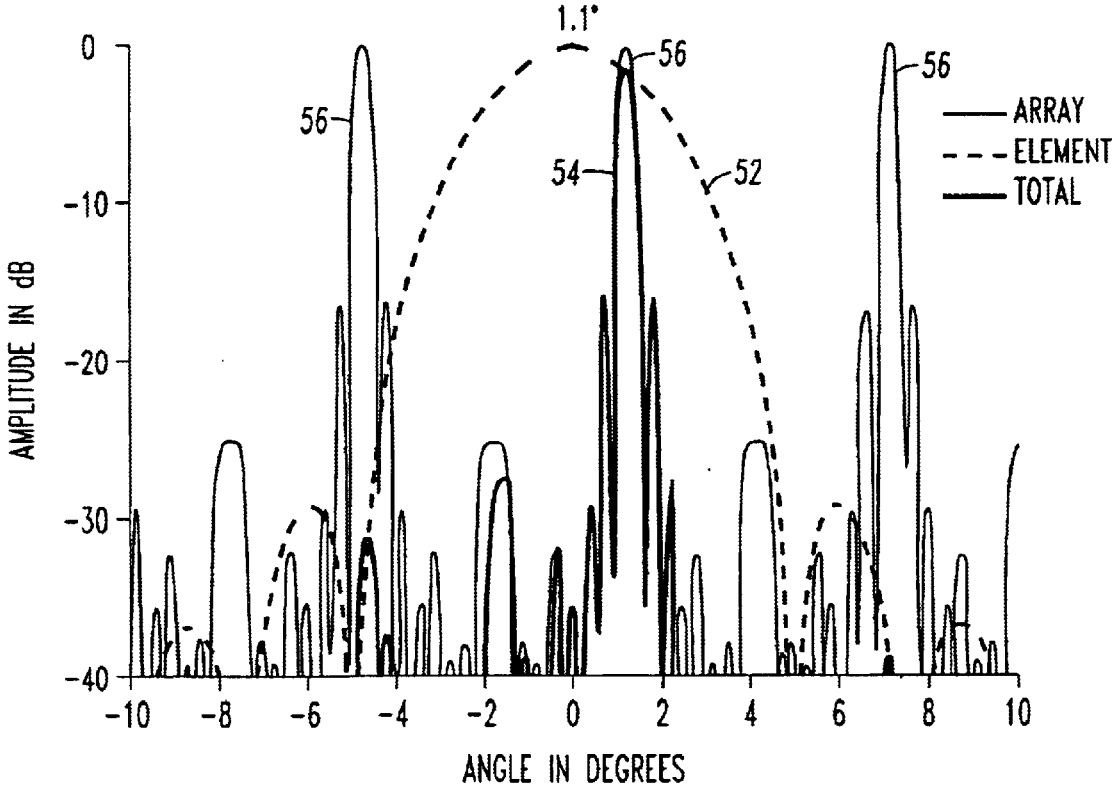

FIGS. 10A and 10B are illustrative of the steering mechanism where group selection again steers the super element beam to 0° by centering the selected feed element in group 37 as shown in FIG. 10A, but the array factor is now steered to 1.1° as shown in FIG. 10B by the grating lobes 56. The main lobe 54 of the composite antenna pattern is also now at 1.1°.

Figure 11A:
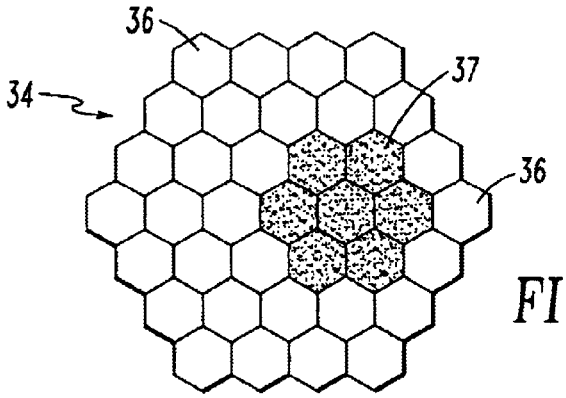
FIGS. 11A and 11B are illustrative of the array steering mechanism where feed group selection steers a super element beam to 2.4°.
Figure 11B:
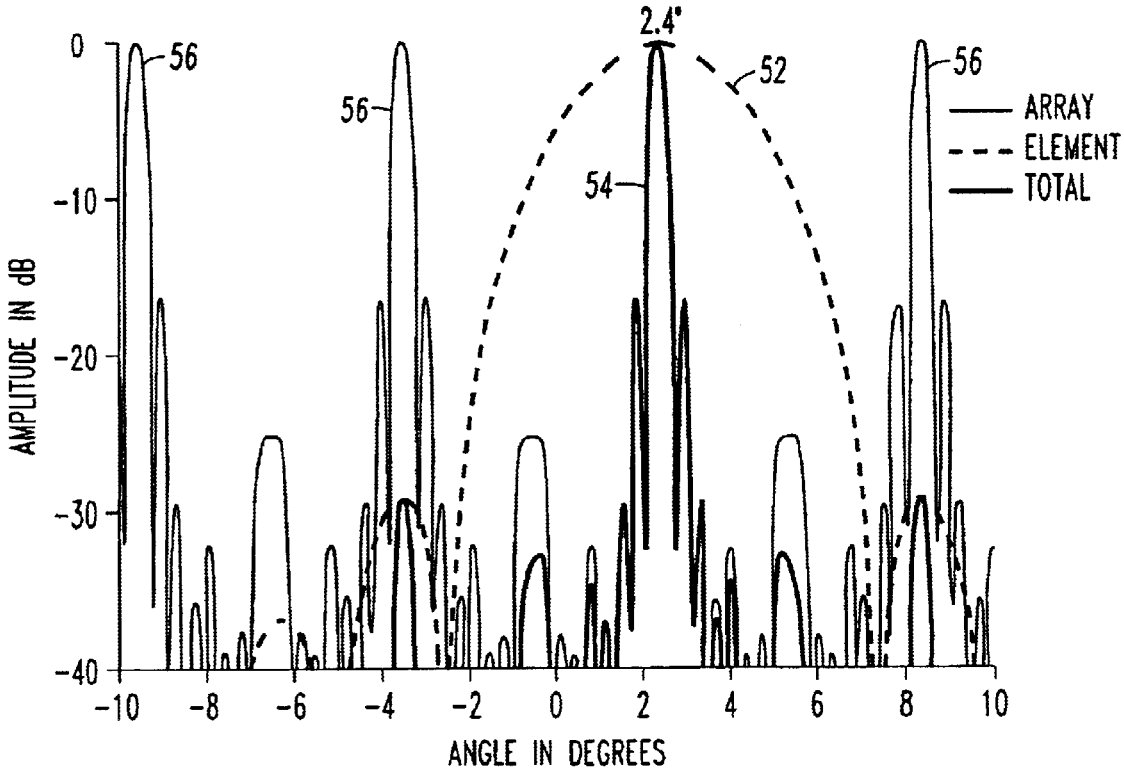

Next, considering FIGS. 11A and 11B, FIG. 11A depicts feed group selection steering of the individual super element beam pattern of feed group 37 to 2.4°, but now the array factor is also steered to 2.4°, which is shown in FIG. 11B and where an individual super element pattern 52 of feed group 37 and the main lobe 54 of the composite antenna pattern are both positioned at 2.4°.

Figure 12A:
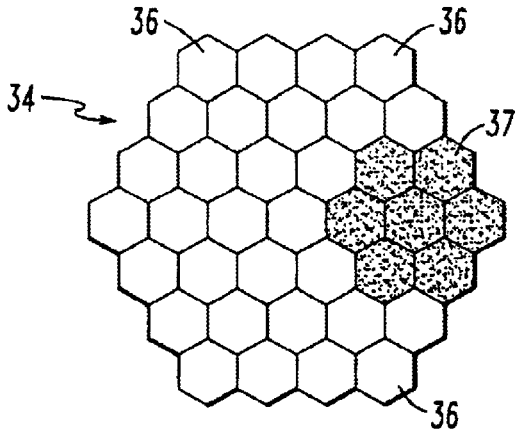
FIGS. 12A and 12B are illustrative of the array steering mechanism where feed group selection steers a super element beam to 4.8° while time delay units steer the array factor to 6°.
Figure 12B:
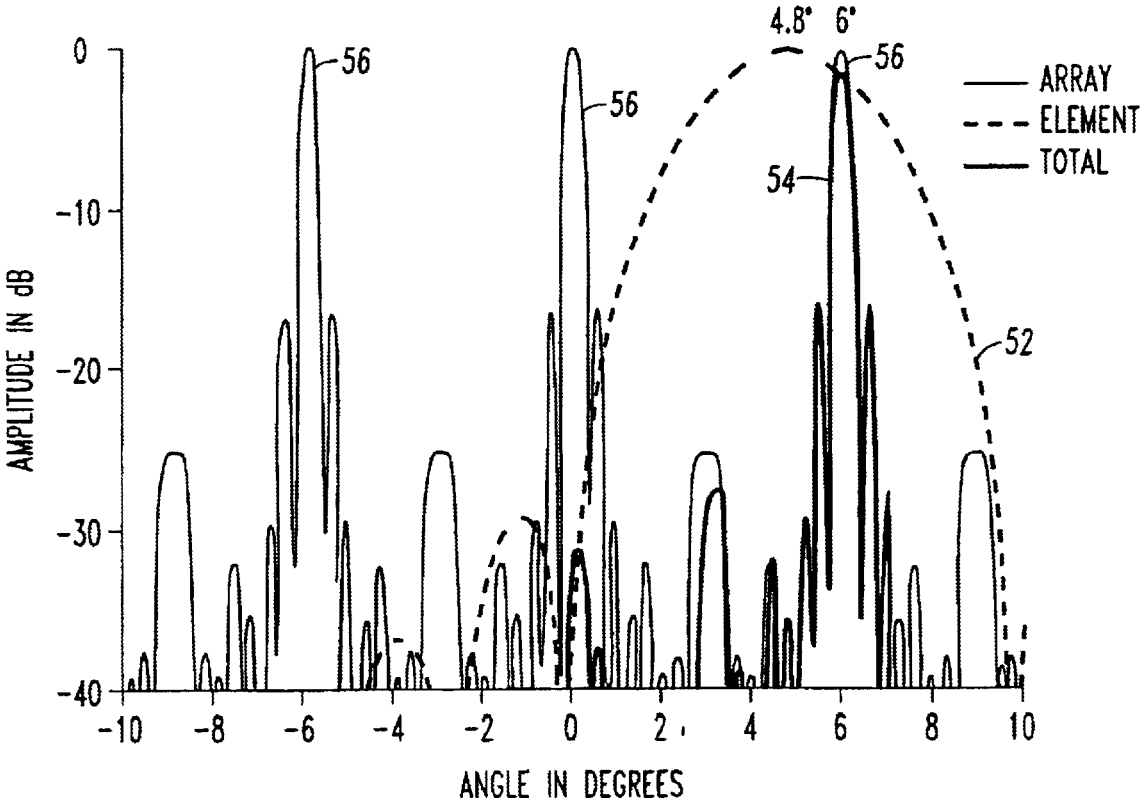

Referring now to FIGS. 12A and 12B, shown thereat is a condition where group selection steers the respective super element beam pattern of feed group 39 (FIG. 12A) to 4.8°, while the array factor is steered to 6° as shown by the grating lobes 56 in FIG. 12B. The main lobe 54 of the composite antenna pattern is now also located at 6°.

Figure 13A:
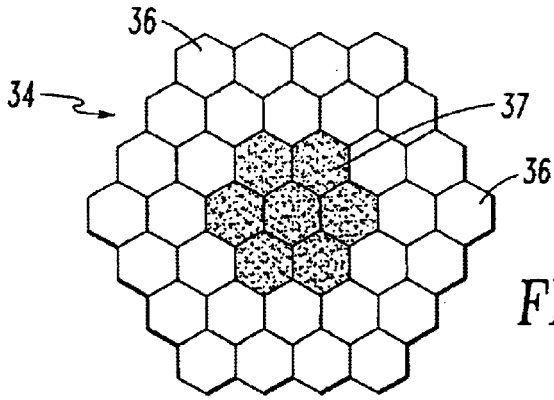
FIGS. 13A and 13B are illustrative of an example of the grating lobe problem occurring when feed group selection steers a super element beam to 0° and time delay units steer the array factor in elevation to 1.386°.
Figure 13B:
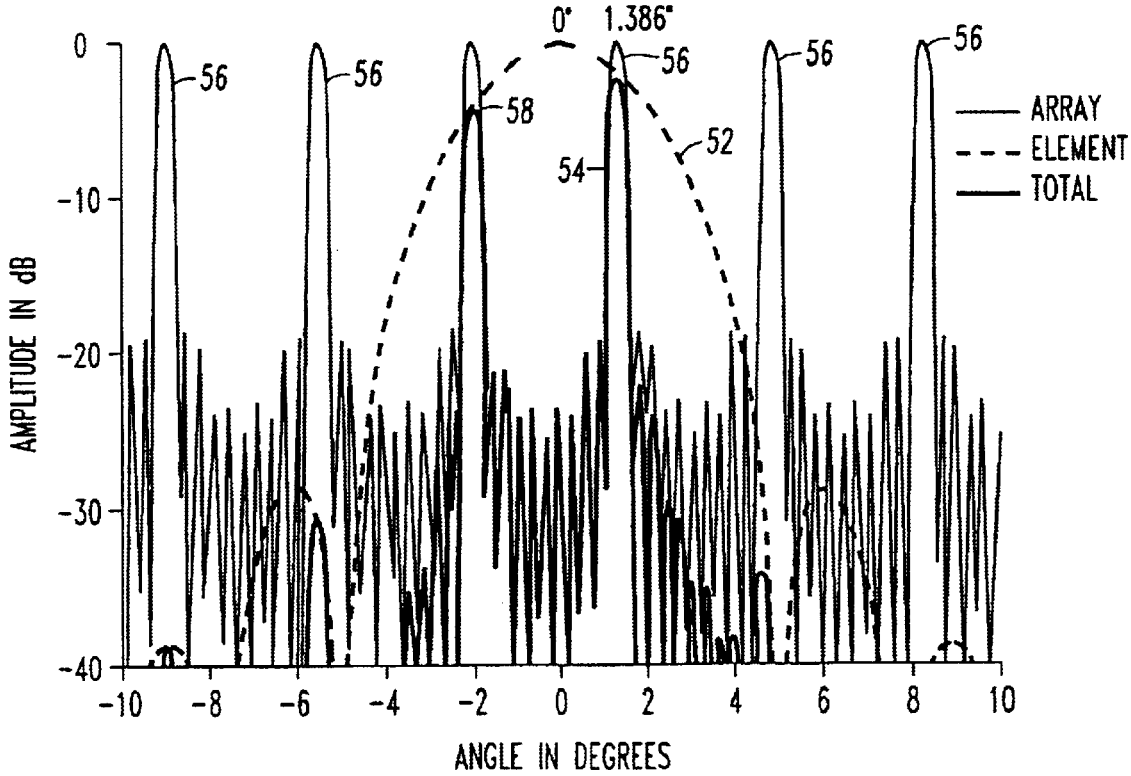

It should be noted, however, that there exists some scan positions where a grating lobe problem arises particularly as it pertains to the composite pattern. For example, as shown in FIGS. 13A and 13B where feed element group selection (FIG. 13A) steers the super element beam to 0°, but the array factor is steered in elevation to 1.386°. As shown in FIG. 13B, it can be seen that while the main lobe 54 of the composite pattern is located at 1.386°, a grating lobe 58 of the composite pattern which is significant in amplitude (down 5 dB) relative to the main lobe 54 is generated.

Figure 14A:
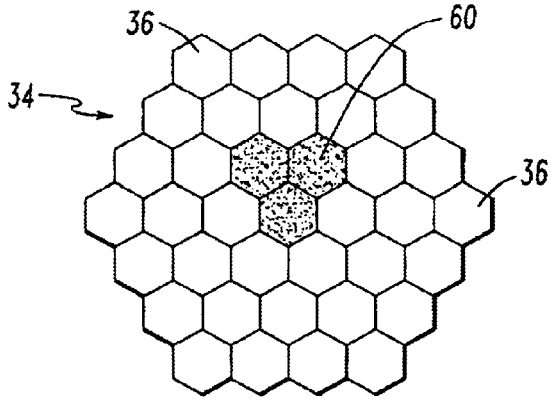
FIGS. 14A, 14B and 14C are illustrative of the method for reducing grating lobes by steering a feed group reduced in number to 1.3860 in elevation where the array factor is scanned to 1.386° in elevation as shown in FIGS. 13B.

This undesirable condition can be overcome by in accordance with this invention selecting a reduced feed element group 60, as shown in FIG. 14A, which consists in a group of only three feed elements 36 and aiming the beam generated by the feed element group 60 (FIG. 14A) at the 1.386° position in elevation. It can be seen in FIG. 14B that the undesirable grating lobe 58 of the composite beam pattern is reduced by almost 20 dB in amplitude relative to the main lobe 54 of the composite beam pattern.

Figure 14C:
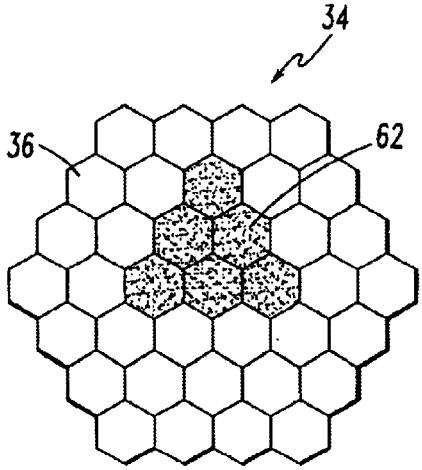
Figure 14B:
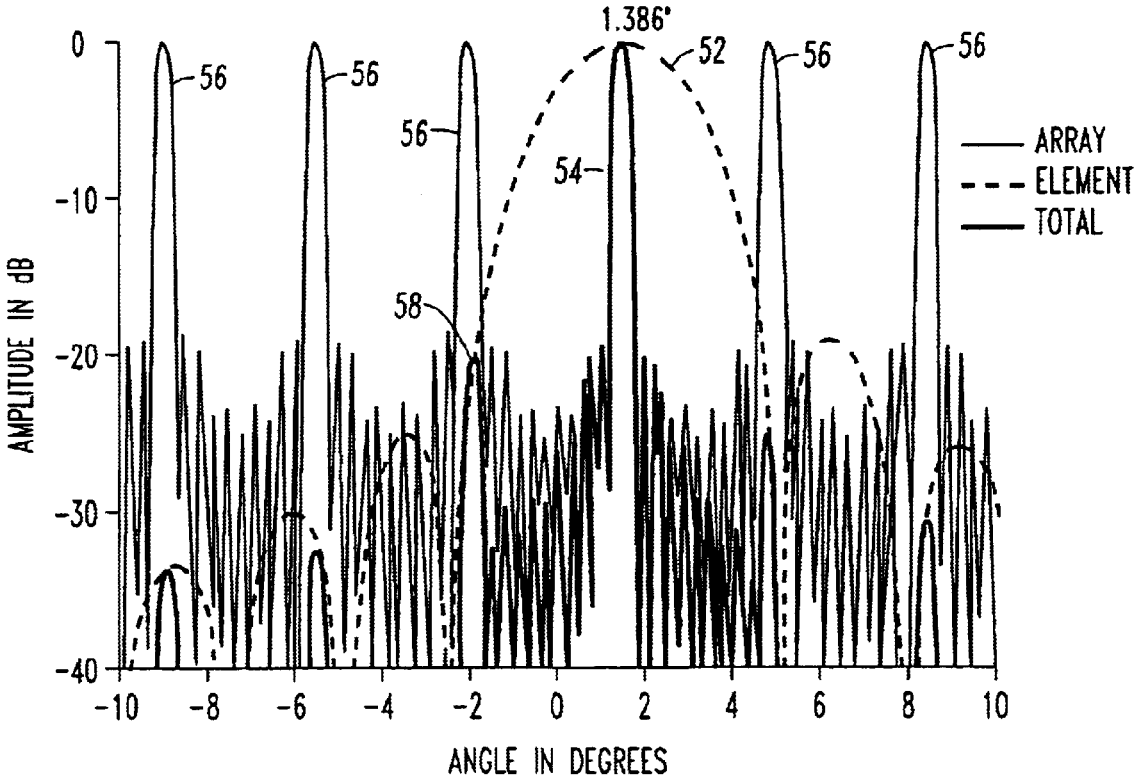

One possible variation of such an implementation shown in FIG. 14A is shown in FIG. 14C where six feed elements 36 are configured in a triangular group 62 as shown.

Figure 15A:
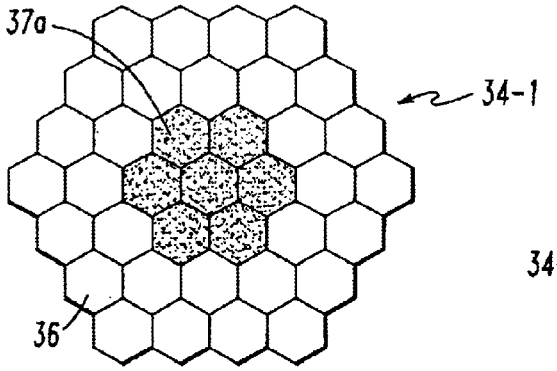
FIGS. 15A–15D are illustrative of another method of reducing the grating lobe problem as shown in FIG. 13B by randomly selecting feed groups.
Figure 15B:
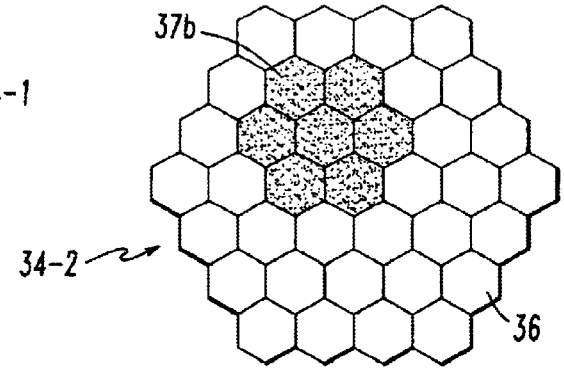
Figure 15C:
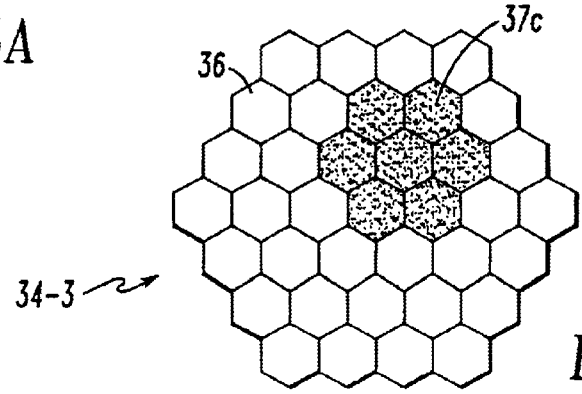
Figure 15D:
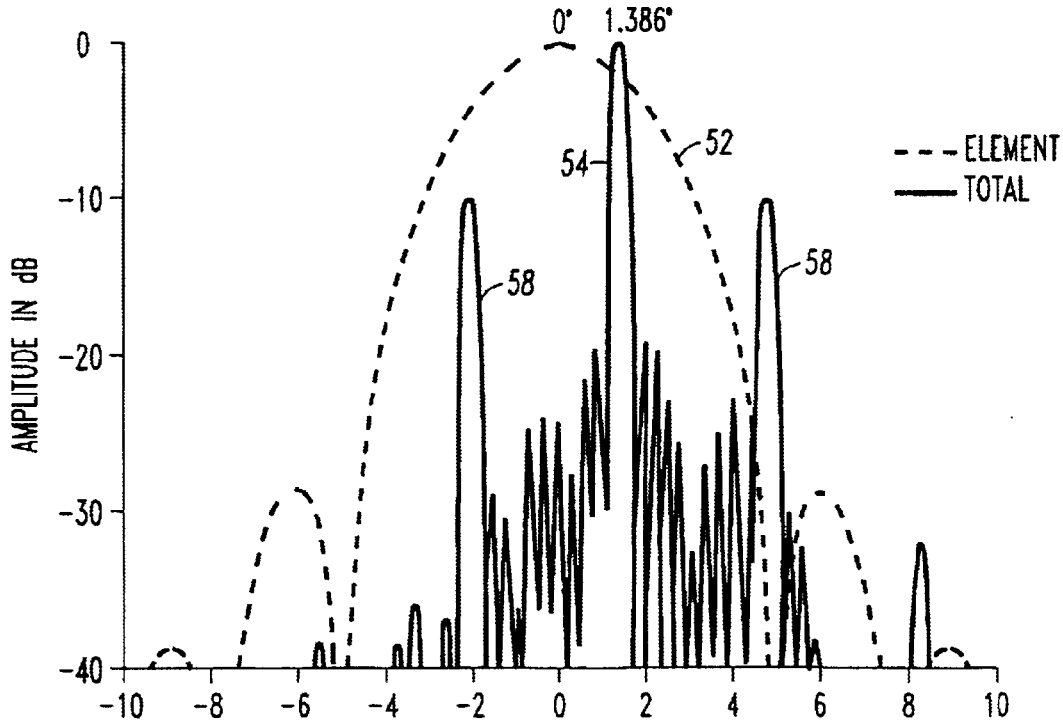

Another method of reducing grating lobes 58 of the composite beam is to randomly select feed element groups about the optimum position as shown in FIGS. 15A, 15B and 15C where the configuration of the selected feed groups $\mathbf{37}_a$ of feed array 34-1 is centered at 0°, while the feed groups $\mathbf{37}_b$ and $\mathbf{37}_c$ of feed arrays 34-1 and 34-2 as shown in FIGS. 15B and 15C are offset to the left and right relative to group $\mathbf{37}_a$. Such an arrangement would produce antenna patterns such as shown in FIG. 15D, where the main lobe 54 of the composite pattern is located at 1.38° in elevation; however, the grating lobes 58 are significantly larger than those depicted in FIGS. 14B, being only 10 dB down from the amplitude of the main lobe 54.

Figure 16A:
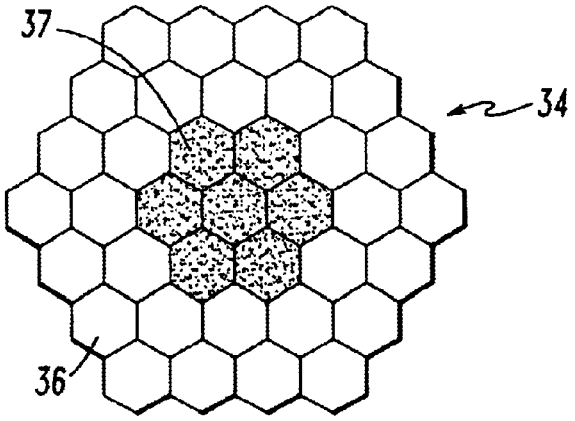
FIGS. 16A–16D are illustrative of still another method of mitigating the grating lobe problem and involves transitioning between beam positions.
Figure 16B:
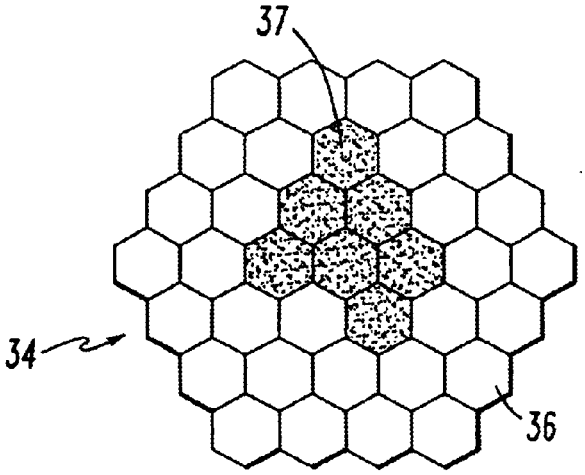
Figure 16C:
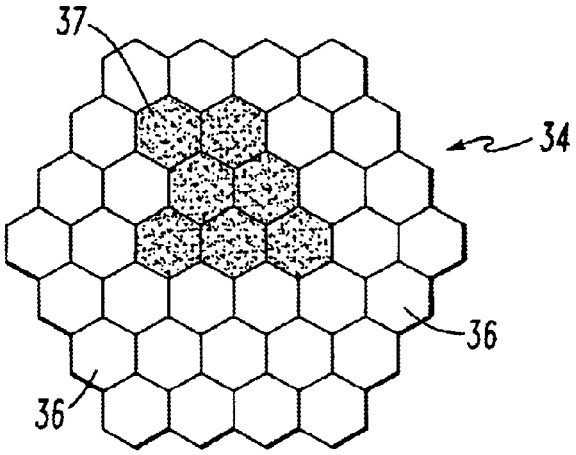
Figure 16D:
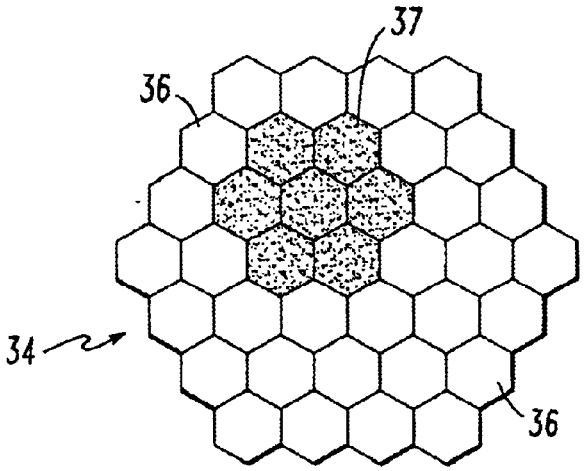

FIGS. 16A–16D depict yet another method of mitigating the grating lobe problem. This involves gradual transitioning from one beam position to another. For example, as shown in FIG. 16A, the feed element group 37 is centered, while in FIGS. 16B and 16C, an irregular pattern of feed elements depicts a transition to the final position as shown in FIG. 16D. In each instance, the same number of feed elements are utilized.

Figure 17A:
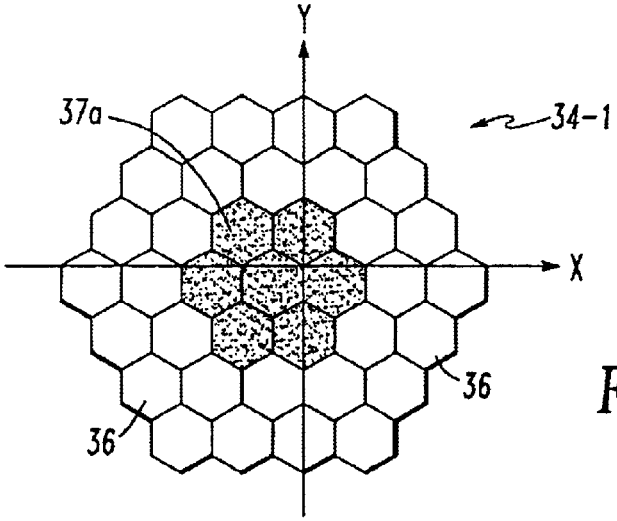
FIGS. 17A–17C are illustrative of yet another method of mitigating the grating lobe problem and comprises random positioning of the feed arrays about respective focal axes.
Figure 17B:
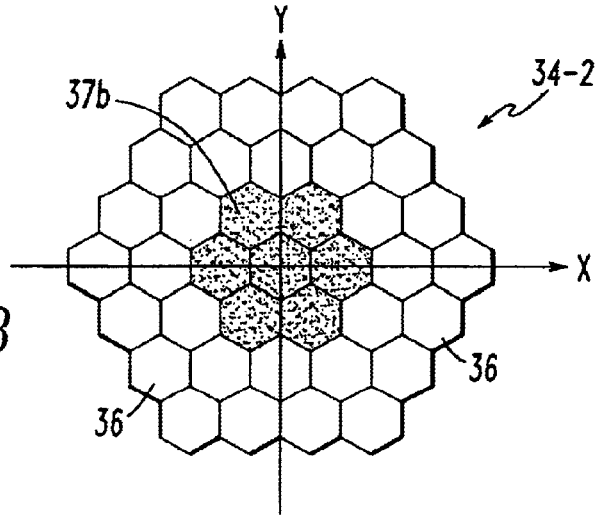
Figure 17C:
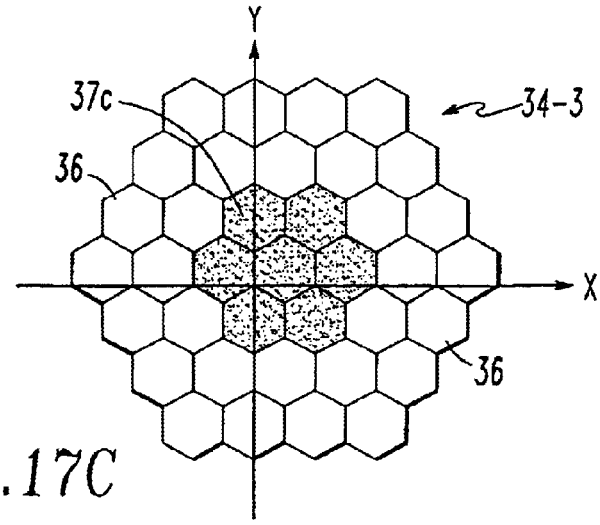

Still another method of mitigating the grating lobe problem is shown in FIGS. 17A, 17B and 17C and comprises randomly positioning the feed arrays, for example, arrays 34-1, 34-2 and 34-3 about the focal point of the respective array which is shown located at the intersection of the X and Y axis.

FIGS. 18A–18C and 19A–19D are illustrative of yet another method of mitigating the grating lobe problem, and involve adjusting the amplitude distribution of each element feed. The distributions are overlapped as required to precisely steer the feed array to the same position as the array factor. The drawback is that the feed array amplitudes are not uniform.

Figure 18A:
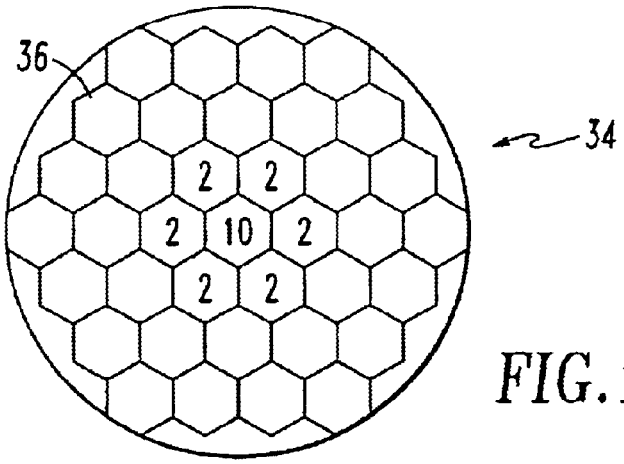
FIGS. 18A–18C are illustrative of still yet another method of mitigating the grating lobe problem which involves overlapping the amplitude distribution of feed elements to steer horizontally between nominal beam positions.
Figure 18B:
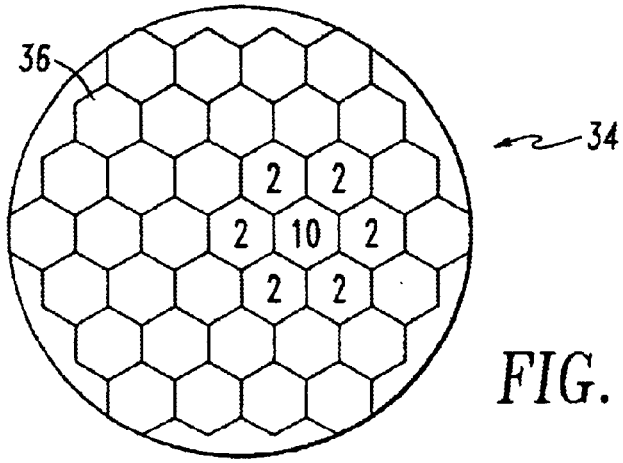
Figure 18C:
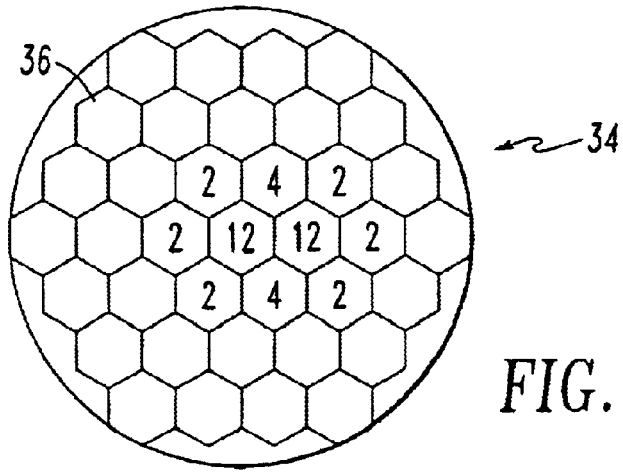

FIGS. 18A and 18B, for example, depict two nominal distributions for beams at 0° and 2.4°. Overlapping distributions form a composite distribution as shown in FIG. 18C which scans the element pattern horizontally exactly half way between beam positions. Thus for that position, there is no error between element pattern beam peak and array factor beam peak. Accordingly, grating lobes are reduced.

Figure 19A:
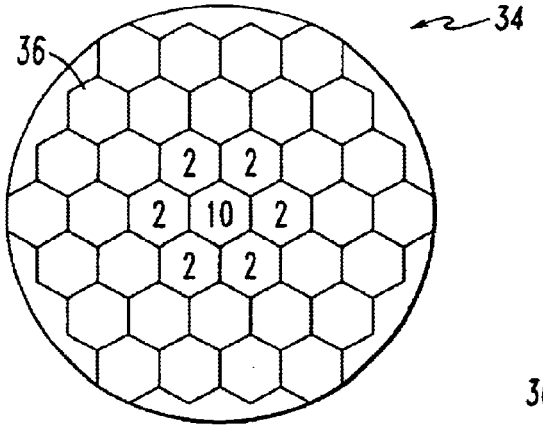
FIGS. 19A–19D are illustrative of still yet another method of mitigating the grating lobe problem which involves overlapping the amplitude distribution of feed elements to steer vertically between nominal beam positions.
Figure 19B:
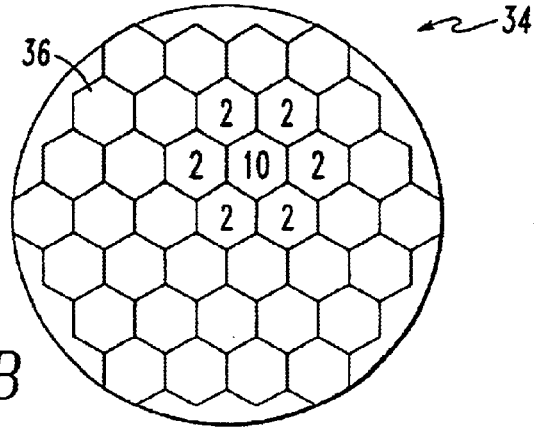
Figure 19C:
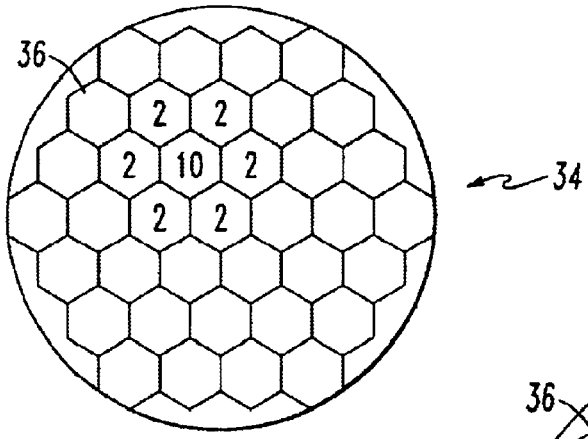
Figure 19D:
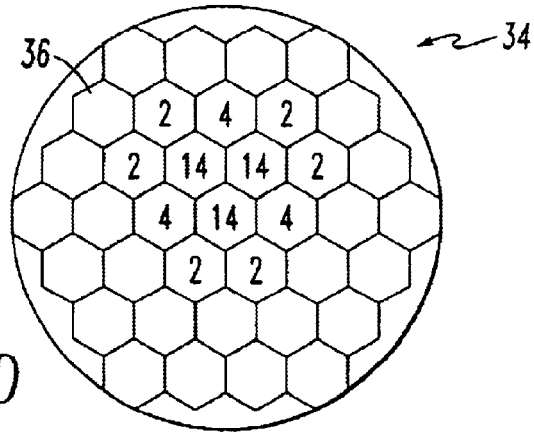

With respect to FIGS. 19A, 19B, and 19C, shown thereat are three nominal distributions for beams at $\theta=0°$, $\phi=30°$ and $\theta=2.4°$, and $\phi=30°$ and $\theta=2.4°$. Overlapping distributions form a composite distribution as shown in FIG. 19D to vertically steer the element pattern exactly to the intersection between positions. Thus for that position, there is no error between element pattern beam peak and array factor beam peak, and thus grating lobes are reduced.

Figure 20:
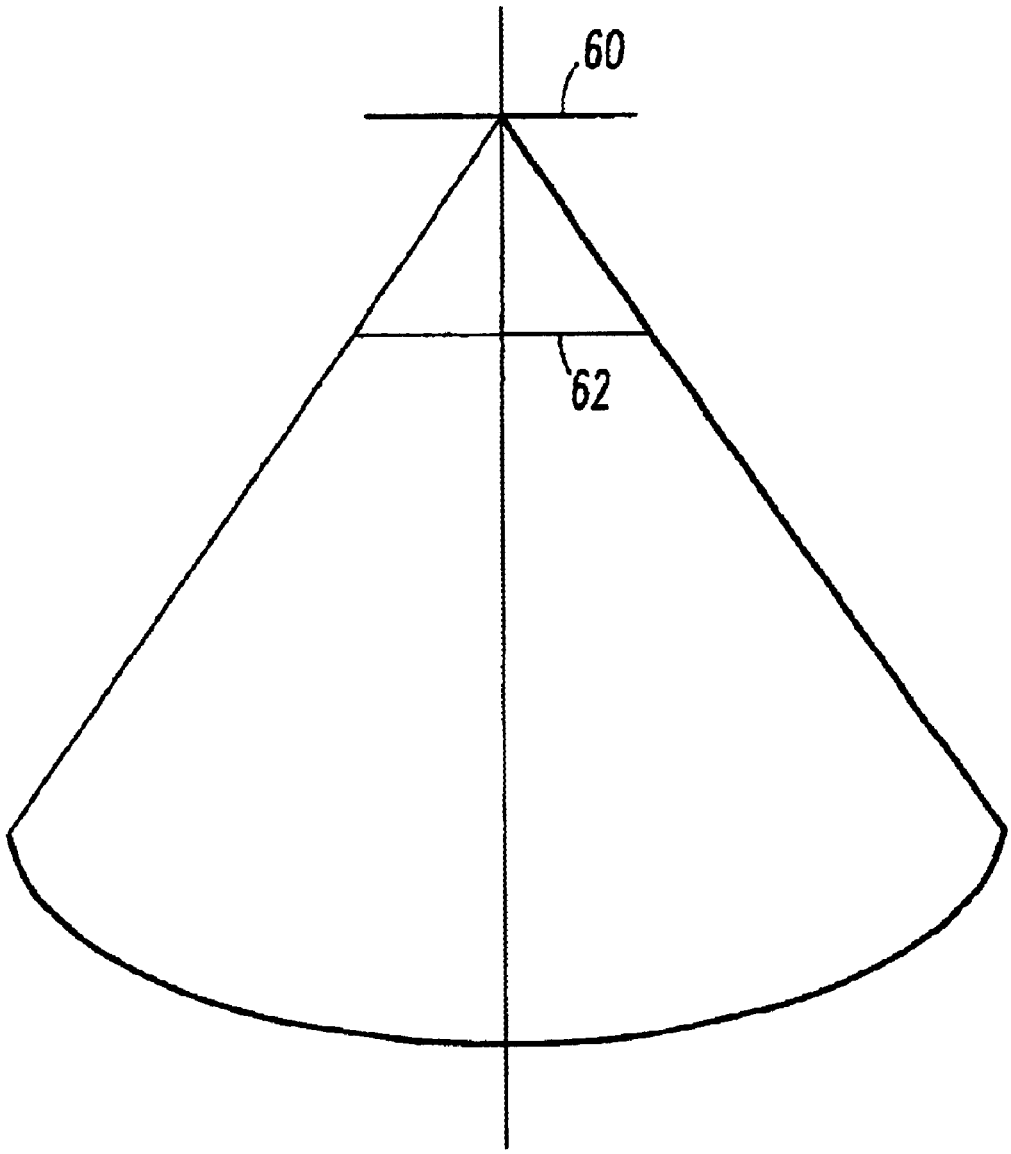
FIG. 20 is a diagram illustrative of a method of distributing power more evenly across a feed array while steering the element pattern to the same location as the array factor.

Referring now to FIG. 20, translating the feed aperture forward of the focal plane 60 to a new location 62 provides a way to distribute the power more evenly across the feed array while precisely steering the element pattern to the same location as the array factor. In this configuration, the amplitude and phase of the feed array elements must be adjusted individually on transmit and receive. In FIG. 20, the precise feed point is determined analytically. An optimum feed is assumed to radiate from that point, and its radiation is projected to the feed plane. The distribution determined at the feed plane is then radiated from there. The benefit of this approach is to distribute the power among all the feed elements. The drawback is that the phase and amplitude must be controlled.

From the above, it will be appreciated that the present invention permits the deployment of a Limited Field of View Antenna for Space Borne Applications by forming a plurality of reflector cells in a flexible reflective membrane using rigid support members that abut the flexible membrane at spaced locations and a mechanism, such as tension wires, that pulls the flexible membrane against the rigid support members to forms the reflector cells.

Having thus shown and described what is at present considered to be the preferred embodiments of the invention, it should be noted that the same has been made by way of illustration and not limitation. Accordingly, all modifications, alterations and changes coming within the spirit and scope of the invention as set forth in the appended claims are herein meant to be included.

What is claimed is:

1. A hybrid parabolic reflector phased array antenna, adapted for deployment in space, comprising:

a reflector support structure;

a plurality of parabolic reflector cells mounted side by side in an open interior portion of the support structure;

each reflector cell including an RF signal reflector and an array of the RF signal feed elements;

each reflector having a flexible reflecting surface and a plurality of elongated edges defining a polygonal geometric shape, and including respective corner portions at the intersection of pairs of edges;

respective rigid support members located at the corner portions of the reflector for stiffening the reflector and the elongated edges, and also for providing a support for the array of feed elements;

a set of flexible support members extending between the rigid support members of each reflector cell and the respective array of feed elements for positioning the array above the RF signal reflector, and a mechanism located beneath each of the RF signal reflector for pulling the flexible reflecting surface down to a substantially parabolic shape.

2. An antenna structure according to claim 1 wherein the reflector support structure comprises a toroidal support structure.

3. An antenna structure according to claim 1 wherein said plurality of parabolic reflector cells are comprised of super element reflector cells arranged in a planar array.

4. An antenna according to claim 1, and additionally including a support member located at the edges of the reflecting surface to prevent stretching of the reflector along the edges.

5. An antenna according to claim 1 wherein said rigid support members comprise a plurality of elongated posts.

6. An antenna according to claim 1 wherein said set of flexible support members comprises wire support members.

7. An antenna according to claim 1 wherein said mechanism for pulling the reflecting surface down comprises a backup structure including a set of wires and tension cables.

8. An antenna according to claim 1 wherein said flexible reflecting surface comprises a reflector mesh.

9. An antenna according to claim 1 wherein said array of feed elements comprises a planar array of feed elements.

10. An antenna according to claim 9 wherein said array of feed elements in each reflector cell is selectively activated in groups of feed elements and wherein said groups are varied in position relative to a focal point of the array to steer a transmitted and/or received beam generated by one or more of the reflector cells.

11. An antenna according to claim 10 wherein the array is also steered by steering of the array factor.

12. An antenna according to claim 10 wherein the array is steered to a position where an undesired grating lobe appears for relieving a grating lobe problem.

13. An antenna according to claim 12 wherein the number of feed elements in at least one of the group is also reduced for relieving the gating lobe problem.

14. An antenna according to claim 10 wherein said groups of feed elements are randomly selected so as to be positioned about a predetermined position of the planar array of feed elements for relieving a grating lobe problem.

15. An antenna according to claim 10 wherein said groups of feed elements are gradually shifted from one position to another for relieving a gating lobe position.

16. An antenna according to claim 10 wherein said groups of feed elements are randomly positioned about respective focal points of the planar arrays for relieving a grating lobe problem.

17. A method of steering a transmitted and/or received beam of a phased array antenna system including a plurality of super element reflector cells each including a parabolic reflector element having a polygonal shape and a plurality of feed elements arranged in a planar array and being mounted on a support structure, comprising the steps of:

activating the feed elements of each feed array in selected groups of feed elements at predetermined locations relative to the focal point of the respective array to achieve a course scan of the beam; and steering the array factor of the beam to achieve a fine scan of the beam.

18. A method according to claim 17 and additionally including the step of overlapping feed distributions of said feed array to gradually shift the feed center of the array to steer the beam between nominal beam positions.

19. A method according to claim 17 and additionally including the step of steering the beam via group selection to substantially the exact location of a grating lobe for relieving an undesirable grating lobe problem.

20. A method according to claim 19 and additionally including the step of reducing the number of feed elements selected in a group for relieving an undesirable grating lobe problem.

21. A method according to claim 17 and additionally including the step of randomly selecting groups of feed elements for positioning said groups about a predetermined position on the feed array for relieving an undesirable grating lobe problem.

22. A method according to claim 17 and additionally including the step of gradually shifting certain groups of feed elements from one position to another for relieving a grating lobe problem.

23. A method according to claim 17 and additionally including the step of selecting groups of feed elements so as to be randomly positioned about respective focal points of the planar arrays for relieving a grating lobe problem.

24. A method according to claim 17 and additionally including the step of overlapping feed distributions of said feed array to steer the feed array to the same position as the array factor peak position for relieving an undesirable grating lobe problem.

25. A method according to claim 17 and additionally including the step of stowing the antenna system in a collapsed state for launch and thereafter deploying the antenna for operation in space.

26. A phased-array-of-reflectors antenna comprising:

plurality of reflector antennas pointed toward a common direction each comprising a reflector having a rim defining a polygonal geometric shape and each comprising a feed array disposed above the individual reflector;

each reflector antenna being disposed adjacent to at least one other reflector antenna in the plurality of reflector antennas to form a phased array antenna using the plurality of reflector antennas as phased array antenna elements so that the signal energy from the plurality of reflector antennas combines to form a beam.

27. A phased reflector array according to claim 26, wherein the plurality of reflectors comprises four or more individual reflectors arranged substantially on a periodic reflector lattice.

28. A phased reflector array according to claim 27 wherein at least one of the feed arrays comprises four or more individual feeds arranged substantially on a periodic feed lattice.

29. A phased reflector array antenna according to claim 28, wherein the periodic feed lattice is a periodic hexagonal feed lattice.

30. A phased reflector array antenna according to claim 27, wherein each feed array is disposed at a corresponding individual reflector focal point.

31. A phased reflector array antenna according to claim 27, wherein the periodic reflector lattice is a periodic hexagonal reflector lattice.

32. A phased reflector array according to claim 26, wherein the plurality of reflector antennas comprises four or more individual reflectors arranged on an aperiodic lattice.

33. A phased reflector array antenna according to claim 26, further comprising:

phase and amplitude control means coupled to each individual reflector for steering the individual reflectors.

34. A phased reflector array antenna according to claim 26, further comprising switching means coupled to the feed arrays for selectively activating and deactivating feeds in the feed arrays.

35. An antenna pattern for a phased reflector array antenna, the antenna pattern comprising a reflector array pattern in product with array-fed reflector patterns, the reflector array pattern generated by a lattice of four or more reflector antennas, having a polygonal geometric peripheral shape, and the array-fed reflector patterns generated by selectively actuable array feeds above the reflector antennas.

36. An antenna pattern according to claim 35, wherein the reflector array pattern is a reflector array pattern corresponding to a lattice of reflector antennas disposed adjacent to one another.

37. An antenna pattern according to claim 35, wherein at lest one of the array-fed reflector patterns is an array feed pattern corresponding to an array feed comprising individual feeds arranged in a lattice.

38. An antenna pattern according to claim 35, wherein the reflector array pattern is a reflector array pattern corresponding to a substantially hexagonal lattice of reflector antennas.

39. An antenna pattern according to claim 35, wherein at least one of the array-fed reflector patterns is an array-fed reflector pattern corresponding to a feed array illuminating a reflector and comprising individual feeds arranged in a hexagonal lattice.

40. A phased reflector array antenna comprising:

a plurality of reflector antennas pointed toward a common direction each comprising a reflector and a feed array, the feed array disposed above the reflector, the reflector comprising a reflector surface having a periphery in the shape of a polygon and including rigid support posts located at corner points of the periphery, and wherein each reflector antenna is disposed adjacent to at least one other reflector antenna and wherein a portion of the periphery is shared with at least one other adjacent reflector antenna in the plurality of reflector antennas to form a phased array antenna using the plurality of reflector antennas as phased array antenna elements to form a communication beam.

41. The phased reflector array antenna of claim 40 wherein the individual reflector antennas have a hexagonal periphery.

42. The phased reflector array antenna of claim 41, further comprising a hexagonal support web around the hexagonal periphery of the reflector surface.

43. The phased reflector array antenna of claim 41 further comprising a hexagonal support web around the hexagonal periphery of the feed support plane surface.

44. The phased reflector array antenna of claim 40, wherein the reflector surface is an elastic RF material reflector surface.

* * * * *